US005181616A

United States Patent [19]

Le Gigan

[11] Patent Number: 5,181,616

[45] Date of Patent: Jan. 26, 1993

[54] GRAIN PROCESSOR

[75] Inventor: Dominique Le Gigan, La-Garenne, France

[73] Assignee: Star Partners, Chicago, Ill.

[21] Appl. No.: 666,782

[22] Filed: Mar. 8, 1991

[51] Int. Cl.[5] ..... B07B 9/00

[52] U.S. Cl. ..... 209/31; 73/865.5; 177/124; 209/154; 209/237; 209/239

[58] Field of Search ..... 209/30, 31, 32, 33, 209/34, 35, 154, 237, 239, 290, 297, 546, 550; 73/865.5, 863.24; 177/50, 124

[56] References Cited

U.S. PATENT DOCUMENTS

| | | | |
|---|---|---|---|
| 3,005,547 | 10/1961 | Freeman | 209/32 |
| 3,181,370 | 5/1965 | Dietert | 209/237 X |
| 3,439,800 | 4/1969 | Tonjes | 209/237 X |
| 4,588,091 | 5/1986 | Wade | 209/546 |
| 4,634,522 | 1/1987 | Edholm et al. | 209/36 X |
| 4,991,721 | 2/1991 | Misra et al. | 209/546 X |

FOREIGN PATENT DOCUMENTS

| | | | |
|---|---|---|---|
| 2643835 | 9/1990 | France . | |
| 0696296 | 11/1979 | U.S.S.R. | 209/239 |

*Primary Examiner*—Donald T. Hajec
*Attorney, Agent, or Firm*—Dvorak and Traub

[57] ABSTRACT

A grain processor for separating and measuring components of a sample of grain as it passes through a rotary sieve having two or more sieving sections having different perforations. The separated particles in each of the sieving sections are passed through a densimetric column containing a stream of pressure-adjustable air generated by a blower to remove impurities from the separated grain which is channeled into a weighing hopper which measures the weight of the grain or impurities and registers the information in a unit provided with data processing and recording circuits, including a microprocessor. Tachometers provide rotational speed pulses to rotation control circuits in the unit which provides an input to motor controllers associated with the motors driving the fans and the rotary sieve. Each of the rotation control circuits is provided with a motor-driven potentiometer coupled to an optical coded disc which provides an output to adjacently-positioned optical heads providing an input into the unit. Alternatively, each of the rotation control circuits may use a solid-state electronic interface between the microprocessor and the motors.

16 Claims, 5 Drawing Sheets

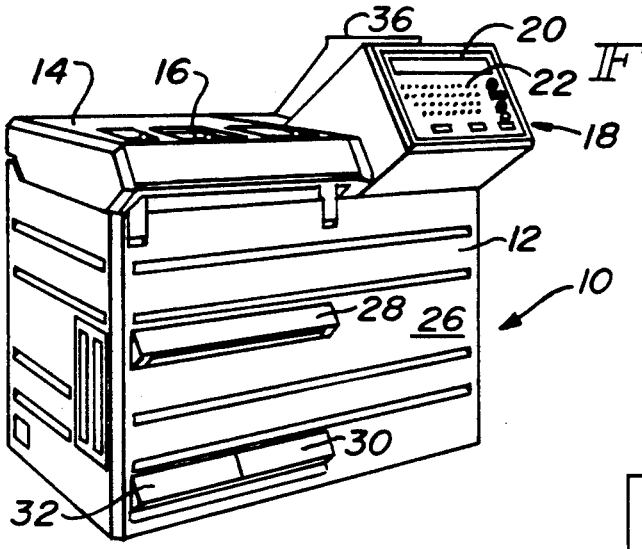
FIG.1
FIG.2
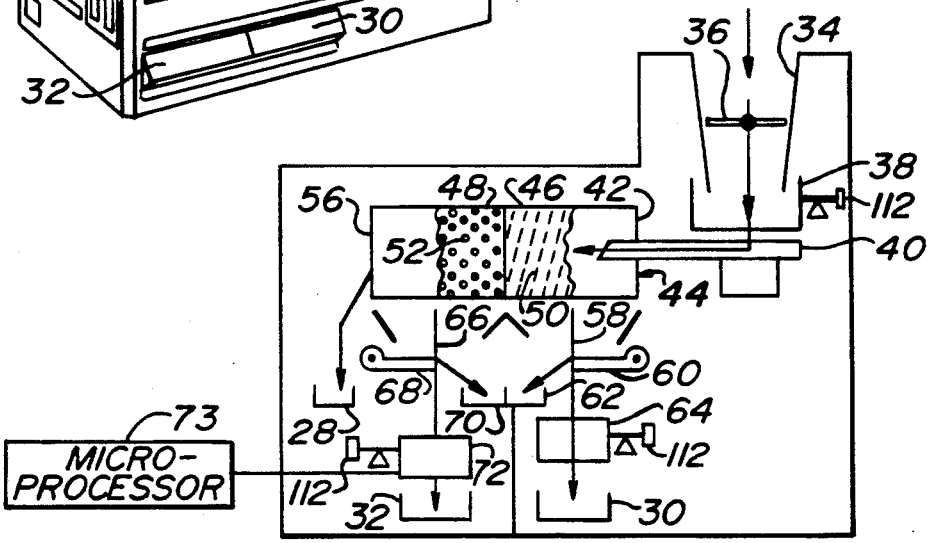
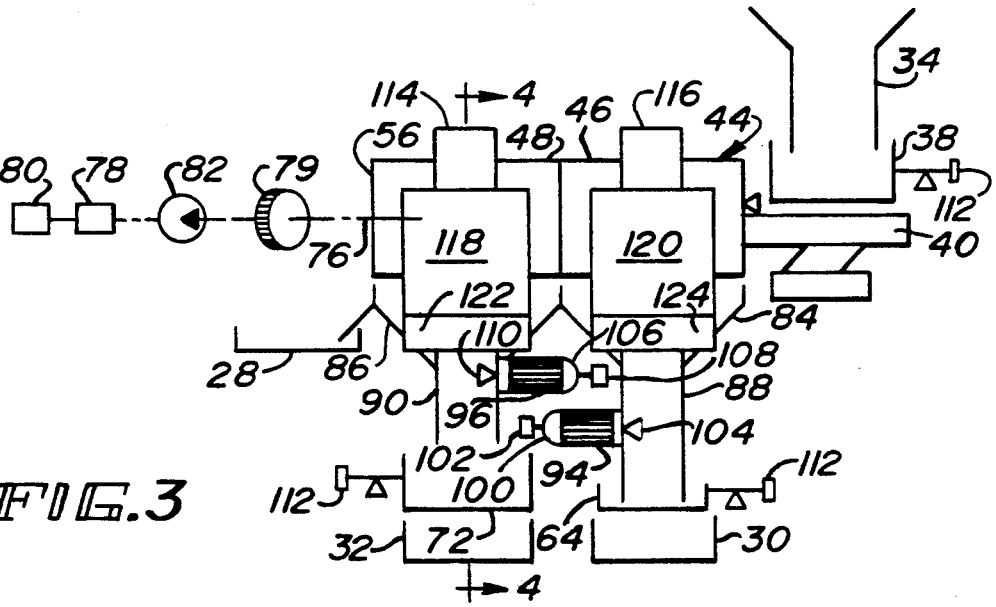
FIG.3

GRAIN PROCESSOR

BACKGROUND OF THE INVENTION

1. Field of the Invention

This invention is concerned with apparatus for separating different constituents of a sample of granular products, and more particularly with apparatus for separating various types of impurities mixed with grain, as well as separating broken and undersized grain from whole grain.

2. Description of the Prior Art

A grain abrading and cleaning apparatus is described in U.S. Pat. No. 2,696,861, wherein dust, flakes, and other impurities are removed from grain. U.S. Pat. No. 4,312,750 is a grain-cleaning apparatus which is mobile in nature and is based upon an inclined rotating screen drum. By means of rotating screen drums, foreign material is separated from grain. U.S. Pat. No. 4,840,727 describes a grain cleaner and an aspirator, wherein banks of decks are gyrating in a flat, horizontal plane, to move a sample of grain contaminated with impurities. An aspirator is used to move and separate the particles in a grain sample. In the foregoing patents, there is no provision for separating broken and undersized grain from whole kernels. In French Patent No. 8902764 there is described an automatic laboratory grain cleaner, wherein a whole sample is introduced into a weighing hopper and then routed by a vibrating distributor to a double-perforation cylindrical screen where dust and broken grain are extracted through a first perforated zone and then the good grain and middle-sized foreign material is extracted through a second perforated zone. Big-sized foreign materials are collected at the exit of the perforated zones. Blowers are used in conjunction with the cylindrical screen to assist in the separation of the foreign particles from the grain.

The devices described in the U.S. Patents also do not have any facilities for separating the components of a mixture and then identifying or classifying the separated components. On the other hand, the apparatus described in the French Patent separates the grain and the impurity particles to provide a percentage of foreign material, broken grain, and total defects, but is not accurate because of possible variation in the blower speeds and rotating screen speed.

SUMMARY OF THE INVENTION

To overcome the disadvantages of the known devices and apparatus, the present invention is directed to an apparatus which will precisely separate various particles in a sample of a grain mixture.

It is in fact necessary to effect this kind of sorting or separating in order to remove the impurities from the good grain and, more particularly, when it is a sample, to separate the impurities in order to determine their proportion in comparison to the total amount of the sample or in comparison to the amount of good grain.

The impurities differ from the good grain by their size and/or density. For example, the following can be achieved in the separation of a grain mixture:

Good grain or good product,

Dust (fine and light particles),

Broken or small grain having possibly a density comparable to that of the good grain but of inferior dimensions, Medium impurities having dimensions comparable to those of good grain but of inferior density, Large impurities having different densities but having dimensions which are larger than those of the good grain.

It is already known to separate grain from impurities by means of densimetric systems, or by sieving. The sieving can be obtained with a horizontal flat surface which is agitated or with a cylinder surface which is rotated. In the flat-type sieving, sieves of different mesh are superposed and vibrated. As a result of gravity, the particles in the grain sample will move from one sieve to another. In a rotary cylinder sieving, the grain sample circulates in a cylindrical sieve with increasing perforations. As usual, gravity is responsible for moving the particles through the different perforations in the sieve.

It is clear that a pure densimetrical sorting is not effective in separating light impurities. Therefore, it is necessary to resort to an aspiration method, which may present a problem of uniform regulation for flow of air and requires the use of a cyclone to recuperate the dust.

In order to have a complete sorting of a sample containing various granules, the invention proposes a cleaner-separator which is remarkable in that it comprises a sieving system furnished with at least one evacuation circuit for the sifted product which crosses a lower part of a column of densimetrical separation provided at its lower extremity, under and in communication with an evacuation system provided with a blower, and at its other extremity, with a decompression chamber. At least one recovery receptacle is installed under the decompression chamber, and another receptacle is installed at the extremity of the evacuation circuit.

It is preferred that the sieving system be provided with several zones of perforations of different sizes, each zone being provided with an evacuation system and a densimetrical separation column. The sieving system consists of a rotary cylinder type and is provided at one of its open extremities with a recovery receptacle for receiving the large impurities, while the other extremity is adapted to receive a test sample. In such a case, the rotary sieving cylinder can, for example, have two zones of different perforations, while a duct funnel is provided under each of the zones to bring the sifted product into its evacuation circuit towards its column of densimetrical separation. Such sieving cylinder can be provided with an interior spiral to facilitate the movement of the test sample from one extremity to the other extremity of the cylinder. The inventive apparatus is provided with various drawers for receiving the grain particles separated from a test sample. In particular, the test sample is weighed originally, and then, during the process, it is separated into one receptacle collecting dust and a drawer for collecting the broken and small grains. The separated good grain is collected in another weighing hopper, and then deposited into a good grain drawer while medium-sized impurities go into another drawer. Finally, the larger impurities fall out of the exit of the rotary sieve into a recovery drawer. By using different weighing hoppers, it is possible to determine the percentage of good and broken grain realized from a test sample. By using a console provided with a viewing screen, keyboard, and an external printer, the results of the weighing process can be indicated on the screen and on a tape. Although the grain processor can be used independently, it can be connected to a computer that can be connected itself to a central processing unit (CPU) at an agricultural headquarters which receives inputs from consoles located at other farm agencies, the agricultural headquarters being responsible for controlling and setting standards for the grading of various grains in the various farm districts. To obtain uniform results in measurements of the particles in a test sample, blower speeds and sieve speed have to be uniform and consistent for all equipments. For achieving this result, two different ways can be used. In the first way, three black boxes containing motorized potentiometers are used. Two are used for setting respectively the air velocity in each of two separation columns, and the third one is used for setting the rotational speed of the cylindrical rotating screening system. The value of the potentiometer may be adjusted either manually by means of a knob on a console or automatically by an electric motor incorporated in the black box. The actual position of the potentiometer may be read at any moment by a microprocessor located in the console. This is achieved by means of an optically coded disc integrated in the black box and which disc rotates on a shaft coupled to the potentiometer. Thereby, this is an absolute coding allowing one to know the actual position of the potentiometer without having to get back to a reference position after each power-on/power-off sequence in using the apparatus. Tachometers are used in conjunction with the blowers and the rotary sieve to indicate the actual value of the rotational speeds of the blowers and the rotating sieve. By measuring the speed of rotation of the blower, a precise air flow can be obtained without the necessity of using Pitot tubes or other flow or pressure sensors in the columns. The tachometers are electro-magnetic sensors which generate a pulse each time a metallic element on a rotating part passes an active surface. For example, one tachometer can be installed in the proximity of the blades of each blower. Another tachometer can be used to detect movement of the teeth on a gear which drives the rotary cylindrical screening system. The pulse frequencies are measured by the microprocessor in the console which then provides output signals for controlling motors which drive the blowers and the cylindrical screening system.

In the second way, the motorized potentiometers are replaced by up and down arrows on a keyboard of a console. The potentiometers themselves do not exist any more, and they are replaced by a solid-state electronic interface which is driven by a microprocessor.

Remote control possibilities are offered by the NSA hardware and software capabilities. Assuming that the air velocity in the column is correlated to the blower speed, the blower pulse frequency is an absolute representative function of the air flow. As a result, different offices of NSA in different places may be remotely programmed from one site (CPU) by a computer, because of the speed information input obtained on a master NSA (CPU) which serves as a reference. The blower speed and the speed of the rotary screen have to be the same for a particular grain on every NSA unit. Each of the weighing hoppers, also known as load cells, is provided with a lock-down device to protect the sensitive measuring elements during transport. The lock-down device may comprise an elongated member generally located below the bottom of a hopper, which member, in one position, supports the hopper in a housing, and, in another position, releases the hopper to move with respect to the housing.

The main object of the invention is to provide a grain processor for performing measurements and computations necessary to obtain the contents of a grain sample.

A further object of the invention is to provide a grain processor adapted to perform the required measurements and computations automatically, and to provide a readout representative of the sample as analyzed regarding the percentage of good grain and impurities.

A still further object of the invention is to provide an analysis instrument integrally arranged in a cabinet containing various drawers for receiving differently separated grain particles and internally associated with a console provided with microprocessor means for providing an output based on the amount of impurities in a test sample and on the type of grain being tested.

A still further object of the invention is to provide a grain processor provided with a console containing microprocessor means and connectable to a main headquarters central processing unit which establishes the standards and qualities for different grains to be tested.

A still further object of the invention is to provide a grain processor associated with a console containing microprocessor means receiving inputs from sensors indicating speeds of the various rotating devices incorporated in the grain processor to control and correlate the rotational speeds of the moving elements to achieve a predetermined velocity in evacuation circuits.

Another object of the invention is to provide a console provided with electrical controllers calibrated for setting the rotational speeds of motors coupled to blowers and the cylindrical rotary sieve.

A further object of the invention is to provide a lock-down device for protecting weighing hoppers and associated scales used in the grain processor.

A still another object of the invention is to provide a grain processor for separating and measuring components of a test sample of grain, wherein a motor driven rotary sieve receives the test sample and has at least two sieving sections, different sections provided with different size perforations, funnels for directing sifted portions to densimetric columns, a motor driven blower being associated with each column for separating impurities from the grain, a weighing hopper coupled to an output of each column for weighing the separated grain and providing a weight signal, a console provided with data processing and recording circuits and including microprocessor means, rotation control circuits associated with the blowers and the rotary sieve and located in the console, means for feeding the weight signals to the console, a speed reading device associated with each blower and the rotary sieve for providing a speed signal input to the respective rotation control circuits in the console, a motor controller connected to each motor, each of the rotation control circuits providing an input signal used to control the speed of the respective motor associated with a blower to maintain a desired air velocity in the respective densimetric separator column.

The foregoing, as well as other objects, features, and advantages of the present invention will be appreciated from consideration of the following detailed description together with the accompanying drawings in which like reference numerals are used throughout to designate like elements and components.

BRIEF DESCRIPTION OF THE DRAWINGS

FIG. 1 is a perspective view of a grain processor;

FIG. 2 is a schematic view of the components in the grain processor;

FIG. 3 is a different type of a schematic of the various components comprising the grain processor;

DESCRIPTION OF THE PREFERRED EMBODIMENT

Figure 4:
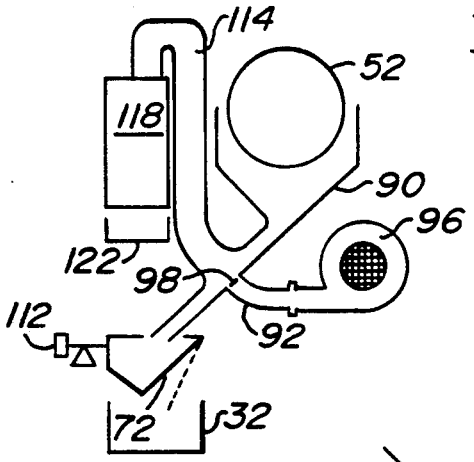
FIG. 4 is a cross-sectional view of FIG. 3 along the lines IV—IV.

Referring to FIG. 1, there is shown a grain processor 10 having a cabinet 12 having an upper portion 14 provided with a hopper opening 16 for receiving a measured quantity of a grain sample into a feed hopper 34. The upper portion 14 may be opened for changing the rotary sieves in accordance with the type of grain to be analyzed. The upper portion 14 is provided at one side with a console 18 provided with a display screen 20 and a keyboard 22. The cabinet 12 has a front face 26 provided with a drawer 28 for receiving separated types of dockage, a drawer 30 for receiving separated broken grain and undersized grain, and a drawer 32 for receiving good grain.

Figure 5:
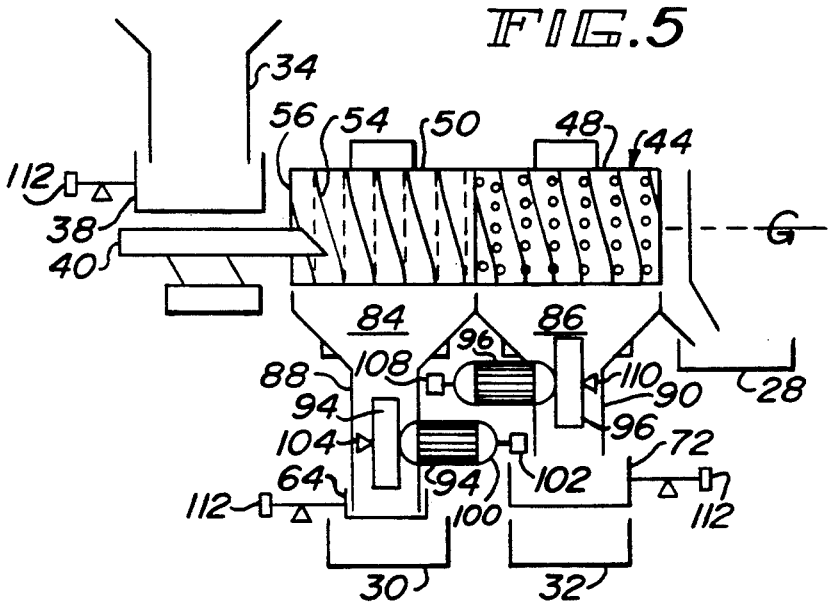
FIG. 5 is a rear schematic view, partially in cross-section, of the apparatus in FIG. 3.

Referring to FIG. 2, the feed hopper 34 is adapted to receive a test sample of impure grain. The feed hopper 34 including a door 36 will channel the test sample into a weighing hopper 38 which is also known as a load cell which transmits the weight of the test sample for processing in a microprocessor unit, as will be explained later. After being weighed, the test sample is unloaded on a vibrating member 40 which directs the sample into the input end 42 of a rotatable sieve cylinder 44 which has a pair of sieving sections 46 and 48, the sieving section 46 having fine perforations and the sieving section 48 having coarse perforations. Momentarily, attention is directed to FIG. 5 to show that the interior of the rotatable sieve cylinder 44 is provided with a spiral 54 to facilitate the movement of the test sample toward an output end 56 of the rotatable sieve cylinder 44.

Referring to FIG. 2, as the test sample travels through the sieving section 46, dust, broken grain, and undersized grain will fall through the fine perforations 50 and be directed into a column 58 which communicates with a blower 60 which blows the dust into a receptacle 62 while the separated product of broken grain and undersized grain falls into a weighing hopper 64 which dumps the separated product into the broken grain drawer 30. The remaining portion of the test sample moves through the sieving section 48 and most of it passes through the coarse perforations 52 into a column 66 communicating with a blower 68 which blows anything lighter than good grain into a receptacle 70 while the good grain is channeled to the weighing hopper 72. After the weighing is completed, the weight information is transmitted to a microprocessor 73, and the grain is dumped into the good grain drawer 32. Anything remaining in the rotatable sieve cylinder 44 exits out of the output end 56 and is received by the trash drawer 28.

As shown in FIG. 3, the sieve cylinder 44 is rotatably supported on four drive rollers. One of the rollers 76 is rotated by a gear 79 coupled to a motor 78 which is controlled by a controller 80. The rotational speed of the roller 76 is monitored by a tachometer 82 which provides a rotational signal output fed to the microprocessor 73, which is connected to the controller 80, as will be explained later. A tachometer 82 can be positioned on anyone of the six rollers 76. If positioned on a non-motorized roller, it can allow to detect the absence of the sieve cylinder, a bad positioning of this cylinder, or eventually skating of the cylinder. Under each sieving section 46 and 48, a duct funnel 84 and 86, respectively, is provided, to channel the sieved product into an evacuation circuit in the form of an inclined duct 88 and 90, respectively. The ducts 88 and 90 communicate with a duct, such as duct 92 coupled to the inclined duct 90 as shown in FIG. 4. The inclined ducts 88 and 90 are associated with respective blowers 94 and 96. The junction between the ducts, such as 92 and the respective inclined duct 90, contains a wire mesh 98 as shown in FIG. 4. The blower 94 is actuated by a motor 100 which is controlled by a controller 102. The speed of the blower 94 is measured by a tachometer 104 which, as mentioned before, transmits a measurement signal to the microprocessor 73. Similarly, the blower 96 is actuated by a motor 106 which is controlled by a controller 108, the speed of the blower 96 being read by a tachometer 110 which provides a speed input signal to the microprocessor 73. Each of the weighing hoppers 38, 64, and 72 is provided with a lock-down device 112.

The inclined ducts 88 and 90 communicate with densimetric sifting columns 114 and 116, respectively. Densimetric column 114 communicates with a decompression chamber 118, and densimetric column 116 communicates with a decompression chamber 120. The decompression chambers 118 and 120 are of the mesh type to allow pulsating air to escape. For example, mesh netting in the decompression chamber 118 may be coarse as opposed to the mesh netting in the decompression chamber 120. Below the decompression chamber 118, a recovery receptacle 122 is provided. A recovery receptacle 124 is provided for the decompression chamber 120.

The control circuit in the microprocessor registers the weighing of the gross weight of the test sample and subsequently actuates the weighing hopper 38 to release the test sample on the vibrating member 40 which directs the test sample into the rotatable sieve cylinder 44 in which the spiral 54 propels the test sample along the longitudinal axis of the sieve cylinder 44.

As previously mentioned, as shown in FIGS. 3 and 4, the perforations 50 in the sieving section 46 are smaller than the perforations in the sieving section 48. In this manner, a mixture of dust and broken grain or small grains will pass through the perforations of sieving section 50 and will fall into the duct funnel 84 which will guide the mixture into the inclined duct 88. At the lower end of the densimetrical column 116, the grain mixture follows its way to the drawer 30 via the weighing hopper 64, while dust is blown by the blower 94 along the densimetric column 116 and comes to rest in the recovery receptacle 124.

In a similar manner, the remainder of the test sample is moved along the sieving section 48, and the particles that fall through the coarse perforations 52, such particles being medium-sized impurities and good grain, are guided by the duct funnel 86 into the inclined duct 90. At the lower end of the densimetrical column 114, the heavier good grain follows its way into the good grain drawer 32, via the weighing hopper 72 which, before opening, weighs the good grain and transmits the weight to be registered in the microprocessor. In the meantime, the medium-sized impurities are blown by the blower 96 into the decompression chamber 118 and deposited in the recovery receptacle 122.

As for the larger impurities still present in the rotating cylindrical sieve cylinder 44, they are propelled out of the output end 56 of the sieve cylinder and fall into the trash drawer 28. In view of the use of several weighing hoppers, it is possible to calculate with suitable electronic circuits, the weights and percentages of the good grain as well as of the impurities present in the test sample. Moreover, the contents of the recovery receptacles and the drawers can be examined and then eventually, manually or automatically, transferred to other instruments or apparatus for conducting other tests, such as determining the moisture content of the grain.

As was previously mentioned, motorized potentiometers are used for setting the air velocity in the two densimetric columns 114 and 116, and also for setting the rotational speed of the rotatable sieve cylinder 44. Such a motorized potentiometer is illustrated and incorporated in a rotation control circuit 126 shown in FIG. 6 wherein the rotation control circuit is entirely supported on a base 128. The base 128 supports a motor 130 having an upwardly directed shaft 132 to which is secured a pulley 134 which is engaged by a belt 136 coupled to a pulley 138 securely mounted on a shaft 140 which has an upper end terminating in a knob 142, the other end being coupled to a rotor (not shown) inside a potentiometer 144 which is secured to the base 128 and which has a connector 146 connected to a power source for driving the motor. A coded disc 148 is mounted on the shaft 140 and is free to rotatably move between optical heads 150 and 152, the optical head 150 functioning as a receiving element, and the other optical head 152 functioning as an emitting element, both of the foregoing being connected (not shown) to a circuitboard 154 having 15 electrical components for processing the information received from optical head 150. The circuitboard 154 is connected to a control circuit in the electronic part of the equipment.

The tachometers 82, 104, and 110 may be used separately or in conjunction with the rotation control circuits (motorized potentiometers) in order to determine the actual value of the rotational speeds of the two blowers 94 and 96 and the rotational speed of the roller 76 or anything else supporting the rotatable sieve cylinder 44. The tachometers are implemented to provide inputs that are processed by the main microprocessor to provide control signals for controlling the rotational speeds of the blowers and the rotatable sieve cylinder. The tachometers 82, 104, and 110 are electromagnetic sensors which generate outputs in the form of pulses each time a metallic portion of the rotating blowers and rotatable sieve cylinder registers a particular movement. For example, the tachometer 104 is installed in close proximity to the blades of the blower 94, and the tachometer 82 detects the teeth of a motor wheel which drives the rotatable sieve cylinder 44. In turn, the pulse frequencies generated by the tachometers are measured by the microprocessor.

The remote control possibilities are offered by the NSA hardware and software capabilities. On the basis that air velocity is correlated to blower speed, the blower frequency is an absolute representative function of the air flow. As a result, different NSA in different places may be remotely programmed from one site by a computer because of the speed which is measured on a master NSA which serves as a reference. The blower speed and the speed of the rotation sieve cylinder have to be the same for a particular grain on every NSA unit.

Figure 8A:
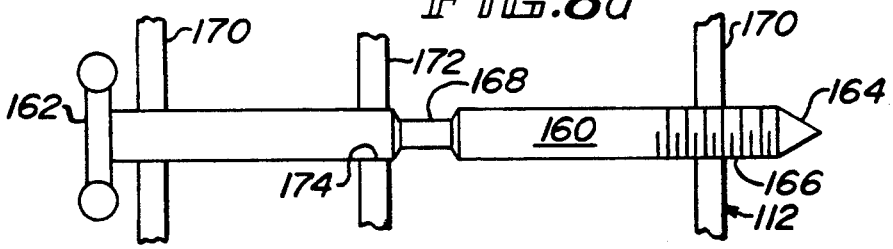
FIGS. 8*a* and 8*b* are simplified views of a lock-down device to immobilize a weighing hopper during transport.
Figure 8B:
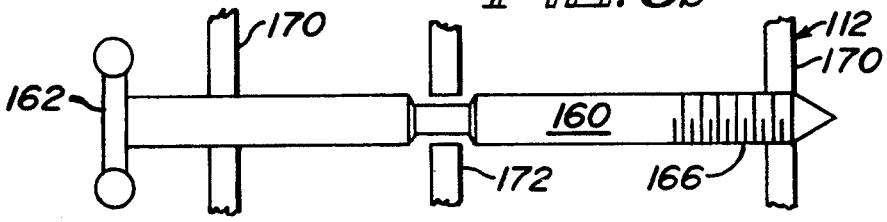

The lock-down devices 112 are used to immobilize the weighing hoppers 38, 64, and 72 whenever the weighing hoppers are not in use. The lock-down device 112 comprises an elongated member 160, as shown in FIG. 8, having at one end a knob 162, the other end of the member 160 having a threaded portion 166 terminating in a conical point 164. Approximately mid-point of the elongated member 160 is a wide groove 168. The elongated member 160 is supported at both ends by portions of a housing 170. Each of the weighing hoppers, such as hopper 38, has a top-extending portion 172 provided with an aperture 174 through which the elongated member 160 passes. As shown in FIG. 8*a*, the elongate member 160, at its greatest diameter, supports the weighing hopper in a locked position when the knob 162 is sufficiently turned clockwise so that the conical point 164 extends substantially past the portion of the housing 170. When it is desired to use the weighing hopper, the knob 162, as shown in FIG. 8*b*, is turned counterclockwise until the groove 168 is aligned with the top-extending portion 172, thereby freeing the weighing hopper for vertical movement.

Figure 9:
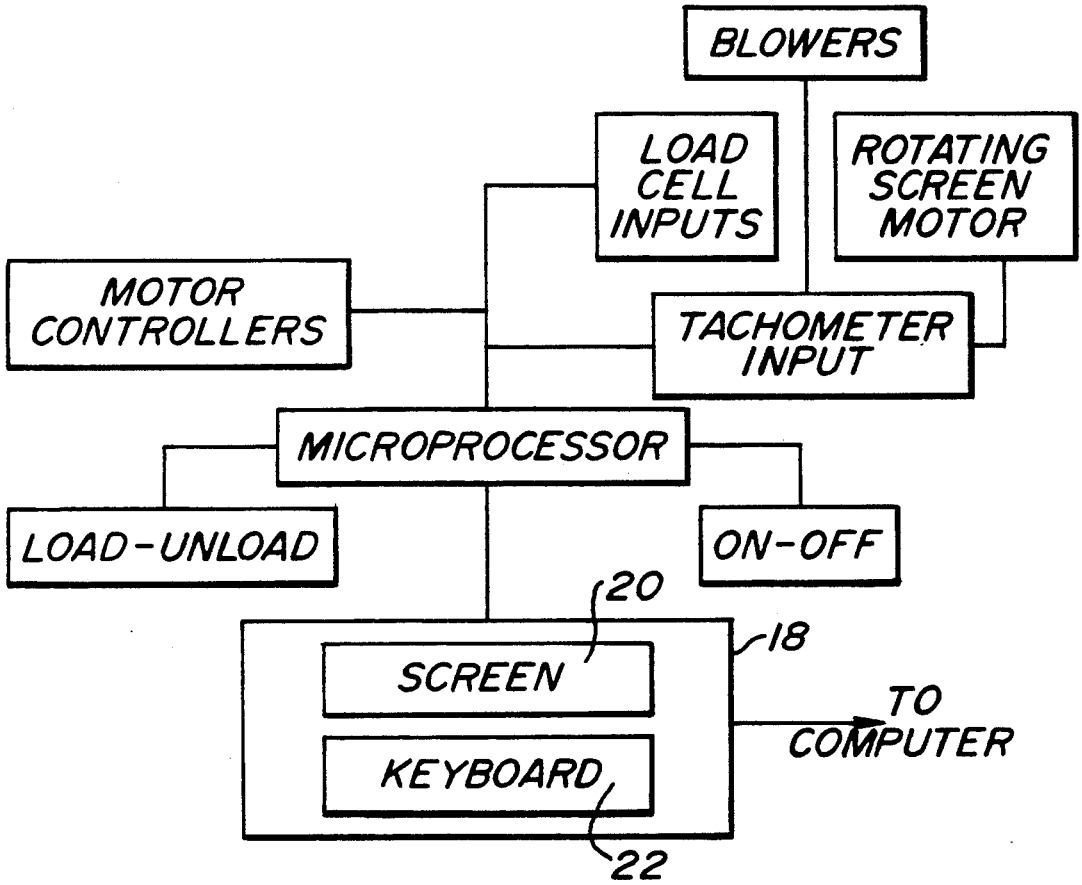
FIG. 9 is a simplified block diagram showing the overall arrangement of the components illustrated in FIGS. 1-6.

FIG. 9 is a simplified block diagram of the various components comprising the grain processor apparatus. As shown in an enlarged illustration, the console 18 has the display screen 20 and a keyboard 22. Although the grain processor 10 can be used independently of any other equipment, as previously explained, a number of such grain processors can be networked together to a main control at a headquarters of a farm agency provided with a computer processing unit (CPU).

Figure 6:
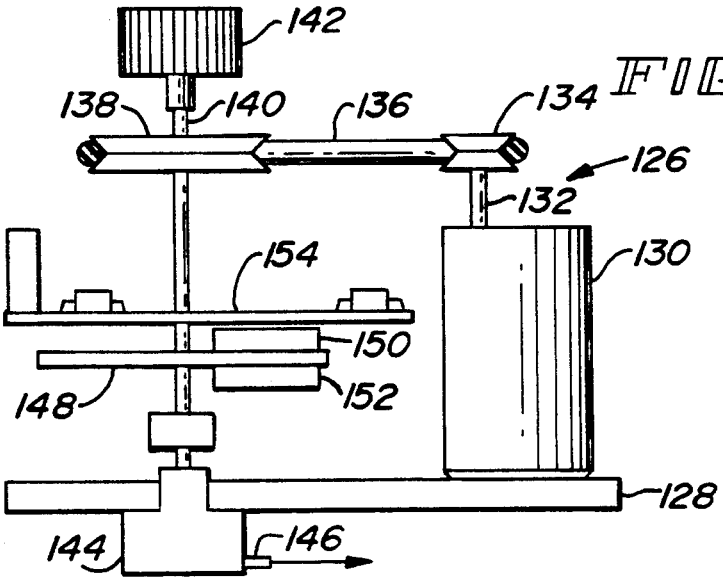
FIG. 6 is an elevation view of a motorized potentiometer to provide inputs for controlling rotational speeds of blowers and a rotary sieve in the grain processor.

Although a motorized potentiometer using a variable resistor has been described as being used in the rotation control circuit 126 shown in FIG. 6, it is possible to use variable inductive or capacitative components instead of a resistive component.

Figure 7:
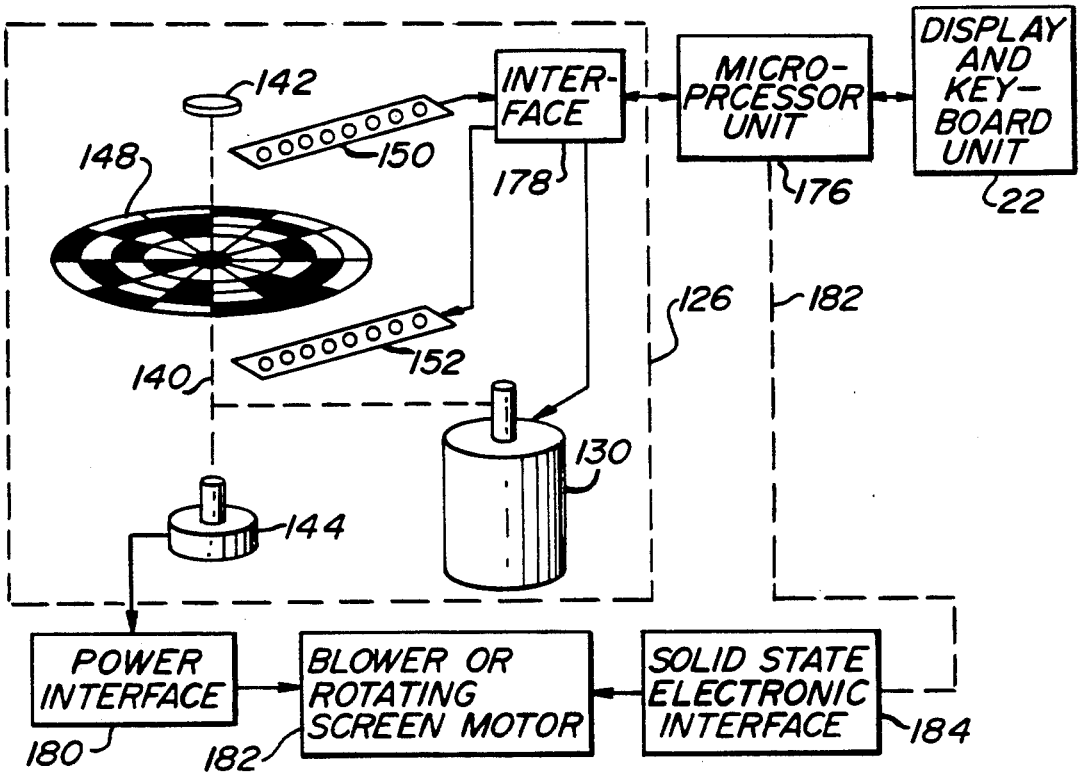
FIG. 7 is another schematic view of the motorized potentiometer shown in FIG. 6.

The rotation control circuit 126 shown in FIG. 6 is shown in a greater detail in FIG. 7 wherein an optically-coded disc 148 has eight tracks divided into 180 sectors of 2° each. For simplicity, only four tracks are shown. The optical head 150 has eight light-receiving diodes, and the optical head 152 has eight light-emitting diodes for reading the actual angular position of the potentiometer 144. The rotation control circuit 126 is connected to a microprocessor unit 176 which, in turn, is connected to the display and keyboard unit 22. The optical heads 150 and 152, as well as the motor 130, are coupled to the microprocessor unit 176 by an interface 178. The output of the potentiometer 144 is connected to a power interface 180 which supplies power input to the block 182 containing motors which operate the blowers 94, 96 and the rotating sieve cylinder 44.

There will now be described the process of setting up the apparatus for separating a test sample containing grain and impurities.

The measuring cycles can be:

learning cycles, operating cycles.

During a learning cycle (CONTROL key), the operator can move manually the knob 142 of each potentiometer in order to obtain the correct speed for each blower and for the rotating screen.

At the end of the learning cycle, the actual position of each potentiometer, represented by the actual optical coding read on the respective disc, is stored in the computer memory by the microprocessor.

If the operator decides to make consecutive learning tests, new settings are stored in place of the preceding ones at the end of each cycle.

The learning cycles are continued by the operator until it is established what rotational speeds of the blower motors and the sieve cylinder motor are best for extracting the optimum amount of good grain in a given time.

During the operating cycle (START key), the microprocessor reads the settings corresponding to the selected grain in the computer memory, and turns each potentiometer until its position (angular coding) is in accordance with the setting.

This movement of the potentiometer is realized by the electric motor 130 which is driven by the microprocessor.

As a further modification of the embodiment shown in FIG. 7, the microprocessor unit 176 may be connected by a line 182 to a solid-state electronic interface 184 for providing power to the electric motors found in block 182. In this case, the motorized potentiometers are replaced by up-and-down arrows 186 on the keyboard 22, as shown in FIG. 10.

Figure 10:
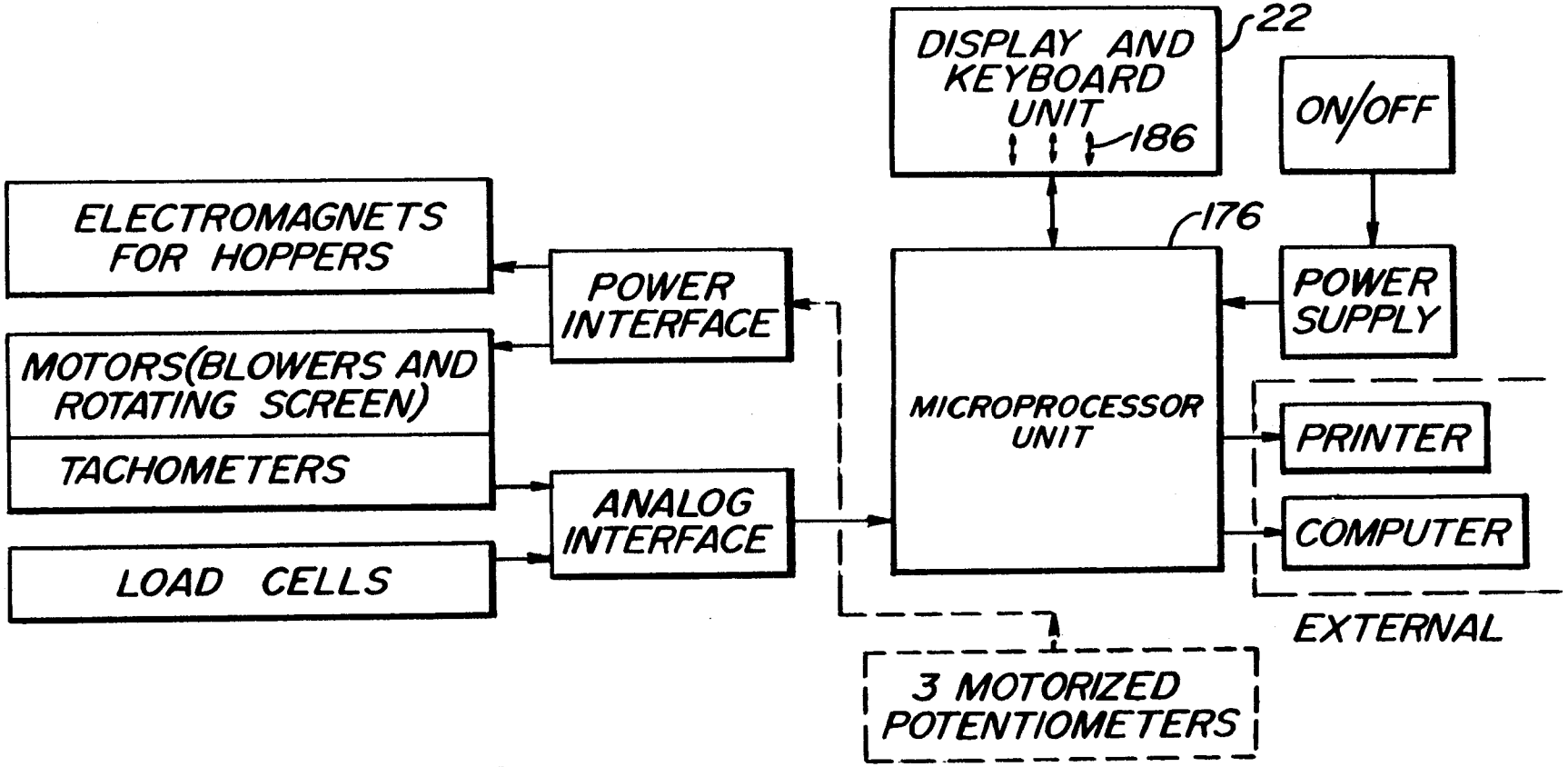
FIG. 10 is a simplified block diagram showing a modification of the overall arrangement shown in FIG. 9.

The simplified block diagram shown in FIG. 9 can be embellished with additional electronic structure using the rotation control circuits 126, as shown in greater detail in FIG. 10.

While a particular embodiment of the present invention has been shown and described herein, various changes are possible and will be understood as forming a part of the invention in so far as they fall within the spirit and scope of the appendent claims.

The invention is claimed as follows:

1. A grain processor for separating and measuring components of a test sample of grain as well as separating impurities from the grain and separating different size impurities comprising, a motor driven rotary sieve for receiving said test sample and having at least two sieving sections, each provided with different size perforations, a plurality of densimetric separator columns, means for directing sieved portions of the sample to said densimetric separator columns, a plurality of motors, a motor driven blower associated with each column for separating the impurities from the grain or different size impurities, a weighing hopper coupled to an output of each column for weighing the separated grain and provided a weight signal, a processing unit provided with data processing and recording circuits including microprocessor means, rotation control circuits associated with said blowers and said rotary sieve coupled to said microprocessor means, means for sending said weight signals to said processing unit, a rotational speed reading device associated with each blower and the rotary sieve for providing a speed signal input to respective rotation control circuits in said unit, a motor controller connected to each motor, each of said rotational control circuits providing an input signal to a respective motor controller via said processing unit to control the speed of the respective motor and associated blower to maintain a desired air velocity int he respective densimetric separator column.

2. A grain processor according to claim 1, wherein said rotary sieve has an output end provided with a recovery receptacle for recovering any remaining unsifted foreign particles.

3. A grain processor according to claim 1, wherein each of said densimetric columns is provided with a recovery receptacle for receiving impurities separated from the grain.

4. A grain processor according to claim 1, including a duct funnel positioned below each sieving section for channeling the sieved particles toward the respective densimetric separation column.

5. A grain processor according to claim 1, including a spiral member extending longitudinally through said rotary sieve and secured to an inside surface of said sieve to move the grain sample toward an output end of the sieve.

6. A grain processor according to claim 1, wherein said data processing and recording circuits register the weight of the grain in all of the weighing hoppers and calculate the proportion of the sieved grain and different impurities with respect to the gross weight of the test sample of grain.

7. A grain processor according to claim 1, wherein said each rotation control circuit includes a variable electrical characteristic changing element mounted for rotation, a motor coupled to said element for changing the electrical characteristic of said element, an optical coded disc simultaneously rotated by said motor, a pair of optical heads adjacent opposed surfaces of said disc to provide signals registering the position of said element with respect to said coded disc, a circuitboard coupled to the optical heads and providing an output to said microprocessor means.

8. A grain processor according to claim 7, including a control knob for manually rotating said electrical characteristic changing element.

9. A grain processor according to claim 7, wherein said variable electrical characteristic changing element is a potentiometer having a rotor rotated by said motor.

10. A grain processor according to claim 1, including a protective device associated with each weighing hopper for immobilizing the movement of a scale.

11. A grain processor according to claim 1, wherein said processing unit includes a display keyboard, coupled to said microprocessor means, said rotation control circuits include solid-state electronic interface intercoupling said microprocessor means and said rotation control circuits.

12. A grain processor according to claim 1, wherein said rotational speed reading device is a tachometer.

13. A grain processor according to claim 11, wherein each blower has several blades, said tachometer being positioned proximate said blades to generate pulse signals.

14. A grain processor according to claim 11, wherein said rotary sieve is mounted on rollers having a gear drive coupled to a respective motor, said tachometer being positioned proximate to teeth on said gear drive to generate pulse signals.

15. A grain processor according to claim 11, wherein said keyboard is provided with up and down levers for setting in said microprocessor means power input signals in said interface.

16. A grain processor according to claim 1, wherein each weighing hopper is provided with a lock-down device for protecting the hopper and associated scale during transit, said device comprises an elongated member slidably extending through apertures in spaced walls of the processor, a wide groove in the central portion of said member cooperatively passing through an aperture in said hopper, wherein in the locked-down position, the width of the member snugly passes through the aperture in the hopper to anchor said hopper and, in the free position, the elongated member is moved to align the groove with the hopper aperture to release the hopper and scale for weighing purposes.

* * * * *